US008739923B1

(12) United States Patent
Callahan

(10) Patent No.: US 8,739,923 B1
(45) Date of Patent: Jun. 3, 2014

(54) MUFFLER FOR VEHICLE EXHAUST SYSTEM

(71) Applicant: Faurecia Emmissions Control Technologies, Columbus, IN (US)

(72) Inventor: Joseph E. Callahan, Greenwood, IN (US)

(73) Assignee: Faurecia Emmissions Control Technologies, Columbus, IN (US)

( * ) Notice: Subject to any disclaimer, the term of this patent is extended or adjusted under 35 U.S.C. 154(b) by 0 days.

(21) Appl. No.: 13/733,205

(22) Filed: Jan. 3, 2013

(51) Int. Cl.
*F01N 13/16* (2010.01)

(52) U.S. Cl.
USPC ..... 181/246; 181/239; 181/258; 181/222; 181/269; 181/212

(58) Field of Classification Search
USPC ..... 181/246, 239, 258, 222, 269, 212, 282
See application file for complete search history.

(56) References Cited

U.S. PATENT DOCUMENTS

| | | | | |
|---|---|---|---|---|
| 4,736,817 | A | 4/1988 | Harwood | |
| 4,847,965 | A | 7/1989 | Harwood et al. | |
| 4,860,853 | A | 8/1989 | Moring, III | |
| 5,173,577 | A * | 12/1992 | Clegg et al. | 181/282 |
| 5,365,025 | A * | 11/1994 | Kraai et al. | 181/249 |
| 6,044,926 | A | 4/2000 | Yamane et al. | |
| 7,004,283 | B2 * | 2/2006 | Worner et al. | 181/239 |
| 7,316,292 | B2 | 1/2008 | Morales et al. | |
| 7,575,096 | B2 | 8/2009 | Arbuckle et al. | |
| 7,730,996 | B2 * | 6/2010 | Van De Flier et al. | 181/256 |
| 7,810,609 | B2 * | 10/2010 | Sikes et al. | 181/250 |
| 7,878,298 | B2 * | 2/2011 | Winter et al. | 181/227 |
| 8,051,949 | B2 | 11/2011 | Henke et al. | |
| 2011/0005860 | A1 | 1/2011 | Abram et al. | |
| 2011/0020917 | A1 | 1/2011 | Wen et al. | |
| 2011/0061969 | A1 * | 3/2011 | Hill et al. | 181/239 |
| 2012/0267191 | A1 | 10/2012 | Danner et al. | |
| 2012/0292128 | A1 | 11/2012 | Keesser et al. | |

FOREIGN PATENT DOCUMENTS

| | | |
|---|---|---|
| GB | 517969 | 2/1940 |
| GB | 1448301 | 9/1976 |
| JP | 61108821 A | 5/1986 |
| UA | 76647 C2 | 8/2006 |

* cited by examiner

*Primary Examiner* — Forrest M Phillips
(74) *Attorney, Agent, or Firm* — Pamela A Kachur

(57) ABSTRACT

A muffler for a vehicle exhaust system includes a first outer shell, a second outer shell that cooperates with the first outer shell to define a muffler interior cavity, and at least one porous partition that separates the muffler interior cavity into at least first and second sub-cavities. In one example, the porous partition is integrally molded with at least one of the first and second outer shells. In one example, an exhaust tube extends through the first sub-cavity and acoustic fiber material is located within the first sub-cavity.

24 Claims, 2 Drawing Sheets

MUFFLER FOR VEHICLE EXHAUST SYSTEM

TECHNICAL FIELD

The subject invention relates to a muffler in a vehicle exhaust system and a method for forming such a muffler. More specifically, the subject invention relates to a muffler having a molded feature for acoustic fiber retention.

BACKGROUND OF THE INVENTION

A vehicle exhaust system component, such as a muffler for example, transmits exhaust gases through an exhaust component body from an inlet to an outlet. Typically, fibrous material such as fiberglass, basalt, etc., is incorporated into the exhaust component body to reduce noise transmissions that are generated as exhaust gases flow from the inlet to the outlet. The material is used to fill all open space within an internal cavity defined within the exhaust component body to provide a fully packed configuration.

Some disadvantages with fully filling the cavity with this material are cost and increased weight. Further, installing this material within the exhaust component body is time consuming and difficult to handle within the production process.

Attempts have been made to minimize the amount of fibrous material used in mufflers. For example, pack optimized location, perforated material, molded packs, and high frequency tuners have all been used to minimize or better locate acoustic fiber. Current manufacturing processes limit the ability to efficiently locate the fiber where it is needed the most and away from areas where the fiber has been ineffective. There is typically a significant cost or additional manufacturing process that is required in order to specifically locate the fiber at a desired location.

SUMMARY OF THE INVENTION

In one exemplary embodiment, a muffler for a vehicle exhaust system includes a first outer shell and a second outer shell that cooperates with the first outer shell to define a muffler interior cavity, with the first and second shells being comprised of a molded material. At least one porous partition is integrally molded with one of the first and second outer shells to separate the muffler interior cavity into at least first and second sub-cavities.

In one example embodiment, a perforated exhaust tube extends through the first sub-cavity and acoustic fiber material located in the first sub-cavity.

In one example, the acoustic fiber material surrounds an outer peripheral surface of the perforated exhaust tube and fills the first sub-cavity.

In one example, the second sub-cavity is free from acoustic fiber material.

In another exemplary embodiment, a muffler for a vehicle exhaust system includes a first outer shell and a second outer shell that cooperates with the first outer shell to define a muffler interior cavity. At least one porous partition separates the muffler interior cavity into at least first and second sub-cavities. An exhaust tube extends through the first sub-cavity and acoustic fiber material is only in the first sub-cavity.

In one example, the first and second shells are comprised of a molded material, such as a polymeric material, for example.

In a further example, the at least one porous partition is integrally molded with one of the first and second shells as a single-piece component.

In a further example, the exhaust tube comprises one of a louvered or perforated tube.

In one example, the acoustic fiber material surrounds an outer peripheral surface of the exhaust tube and fills the first sub-cavity. The second sub-cavity is free from acoustic fiber material.

In one example, the at least one porous partition comprises a first porous partition portion integrally formed with the first outer shell and a second porous partition portion integrally formed with the second outer shell. The first and second porous partition portions cooperate with each other to form the first and second sub-cavities.

In one example, a method for forming a muffler for a vehicle exhaust system includes molding first and second outer shells that are subsequently attached to each other to define a muffler interior cavity, and integrally molding at least one porous partition with at least one of the first and second outer shells.

In one example, additional steps include attaching the first and second outer shells to each other such that the at least one porous partition divides the muffler interior cavity into first and second sub-cavities, installing an exhaust tube to extend through the first sub-cavity, and introducing acoustic fiber material into the first sub-cavity.

These and other features may be best understood from the following drawings and specification.

DETAILED DESCRIPTION

Figure 1:
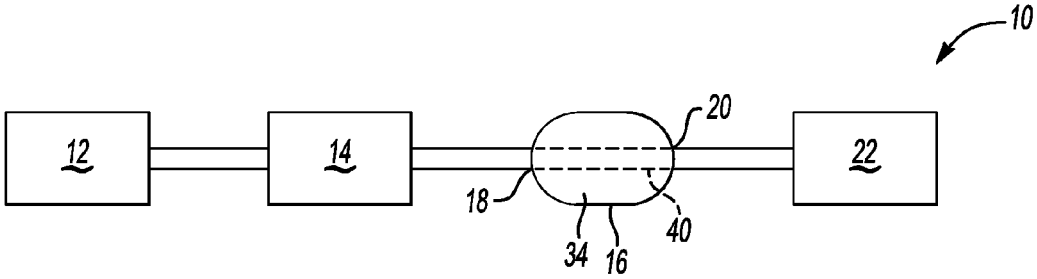
FIG. 1 is as schematic representation of a vehicle exhaust system with a muffler incorporating the subject invention.

FIG. 1 shows a vehicle exhaust system 10 that conducts hot exhaust gases generated by an engine 12 through various upstream exhaust components 14 to reduce emission and control noise as known. The various upstream exhaust components 14 can include one or more of the following: pipes, filters, valves, catalysts, mufflers etc. In one example configuration, the upstream exhaust components 14 direct exhaust gases into a muffler 16 having an inlet 18 and an outlet 20. The outlet 20 communicates exhaust gases to downstream exhaust components 22. The various downstream exhaust components 22 can include one or more of the following: pipes, filters, valves, catalysts, mufflers etc. These upstream 14 and downstream 22 components can be mounted in various different configurations and combinations dependent upon vehicle application and available packaging space.

Figure 2:
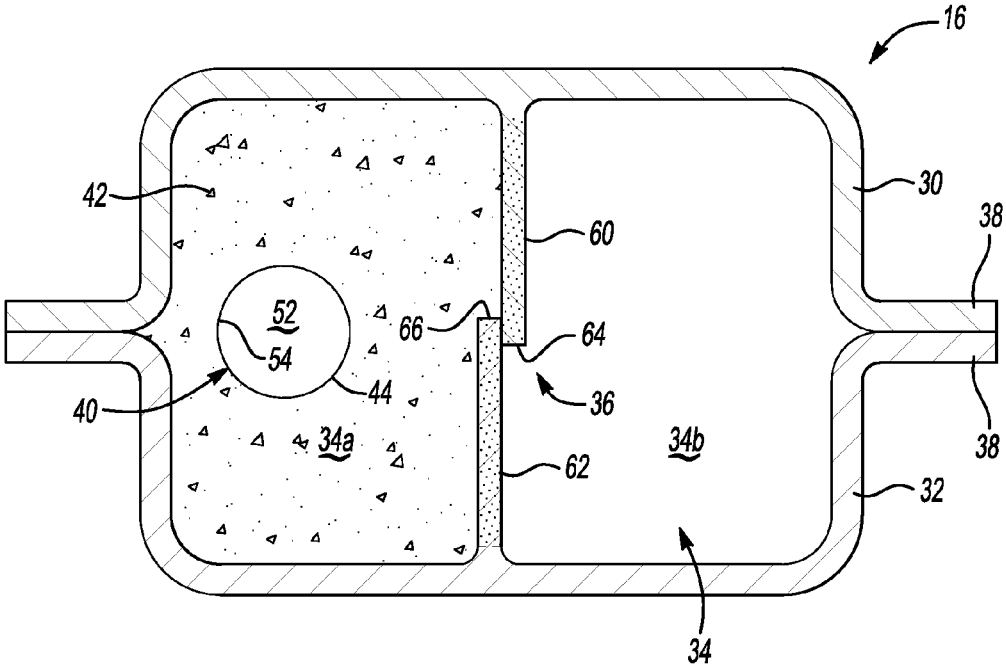
FIG. 2 is a schematic cross-sectional end view of the muffler incorporating the subject invention.

As shown in FIG. 2, in one example, the muffler 16 includes a first outer shell 30 and a second outer shell 32 that cooperates with the first outer shell 30 to define a muffler interior cavity 34. In one example, the first 30 and second 32 shells are comprised of a molded material. At least one porous partition 36 is integrally molded with at least one of the first 30 and second 32 outer shells to separate the muffler interior cavity 34 into at least first 34*a* and second 34*b* sub-cavities.

In one example, the molded material comprises a polymeric material. The first 30 and second 32 outer shells comprise non-porous members, i.e. solid members, such that exhaust gas does not leak out to the external environment. The first 30 and second 32 outer shells are attached to each other via mating flange portions 38 to form the enclosure for the muffler interior cavity 34. The shells 30, 32 can be attached to each other using any of various methods including welding or brazing, for example.

Figure 3:
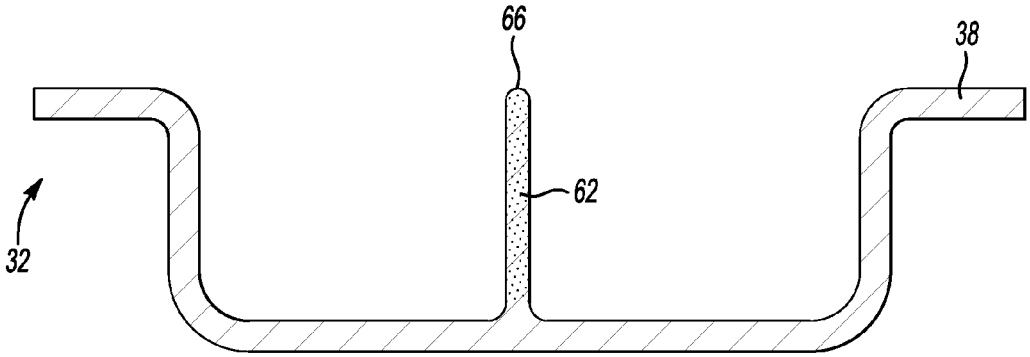
FIG. 3 is a cross-sectional view of one of first and second outer shells that form the muffler.

The porous partition 36 comprises a baffle or stake member that is integrally molded with one or both of the non-porous first 30 and second 32 outer shells (see FIG. 3). The porous partition is permeable to fluids such as exhaust gas, for example. As such, the porous partition 36 comprises a rigid structure that includes a plurality of pores, openings, etc. through its thickness that allow exhaust gas to pass between the first 34*a* and second 34*b* sub-cavities by going through the partition 36 from one side to an opposite side. Thus, the partition 36 has a certain percentage of open area, i.e. porosity, through its cross-section. The percentage of porosity can be varied dependent upon various characteristics such as vehicle application, desired noise configuration, etc.

An exhaust tube 40 extends through the first sub-cavity 34*a* from the inlet 18 to the outlet 20 (FIG. 1). In one example, the exhaust tube 40 comprises the only tube that extends through the muffler 16. Acoustic fiber material 42 surrounds an outer peripheral surface 44 of the exhaust tube within the first sub-cavity 34*a*. In one example, the acoustic fiber material 42 is only in the first sub-cavity 34*a*, with the second sub-cavity 34*b* being free from acoustic fiber material. In one example, the acoustic fiber material 42 completely fills or packs the first sub-cavity 34*a*. Any type of acoustic fiber material suitable for usage in the high temperature environment of a vehicle exhaust system can be used to fill the sub-cavity.

Figure 4:
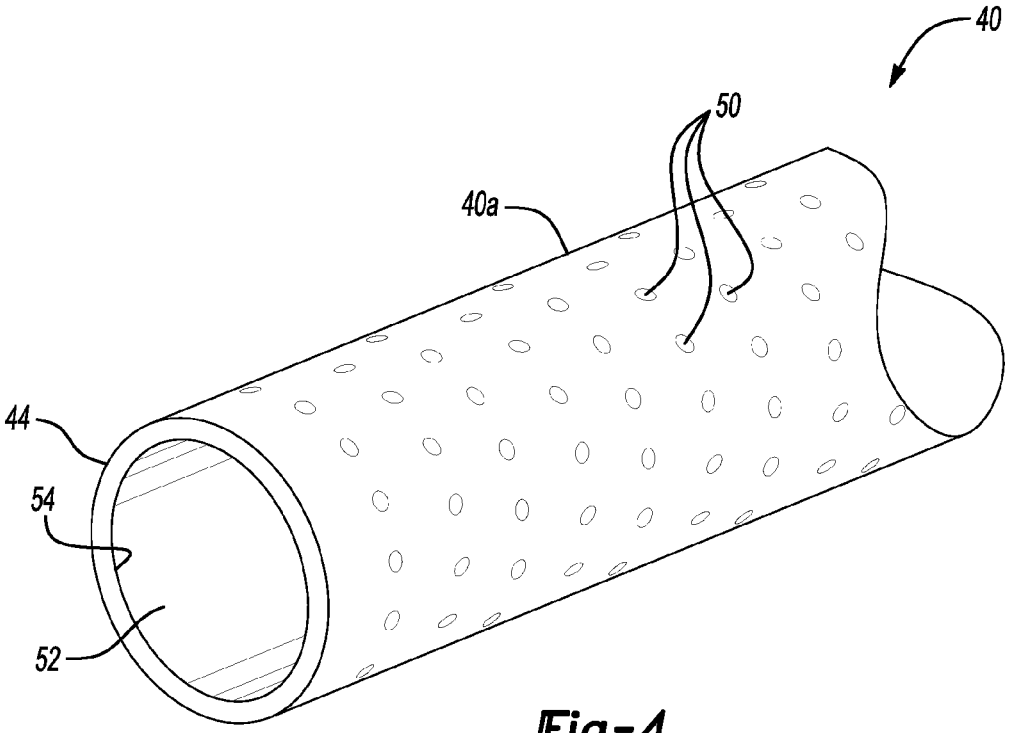
FIG. 4 is a perspective view of one example of an exhaust tube extending through the muffler.
Figure 5:
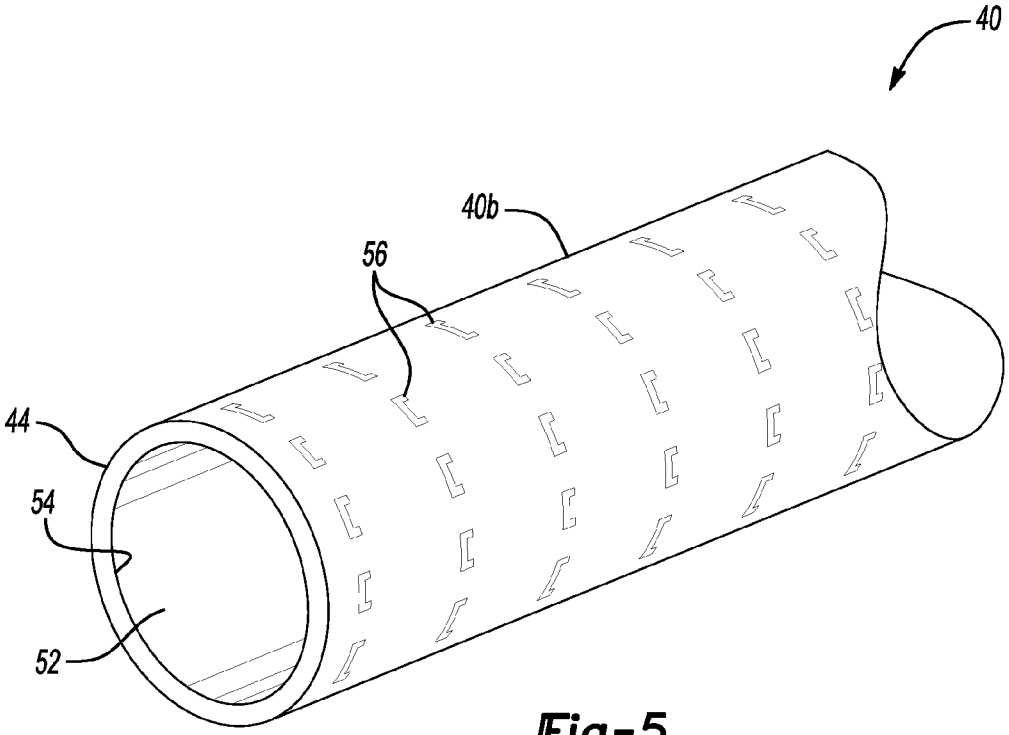
FIG. 5 is a perspective view of another example of an exhaust tube extending through the muffler.

The exhaust tube 40 comprises one of a perforated tube 40*a* (FIG. 4) or a louvered tube 40*b* (FIG. 5). The perforated tube 40*a* includes a plurality of holes or openings 50 that allow exhaust gas to pass from an exhaust gas flow path 52 defined by an inner peripheral surface 54 of the exhaust tube into the first sub-cavity 34*a*. The louvered tube 40*b* includes a plurality of tabs or louvers 56 that allow exhaust gas to pass from the exhaust gas flow path 52 into the first sub-cavity 34*a*.

In either example, the tubes 40*a*, 40*b* are located only in one of the first 34*a* and second 34*b* sub-cavities, leaving the other of the first 34*a* and second 34*b* sub-cavities empty. The exhaust tube 40*a*, 40*b* extends entirely through the associated sub-cavity from the muffler inlet 18 to the muffler outlet 20. Further, the sub-cavity that includes the pipe 40*a*, 40*b* is the sub-cavity that is filled with the acoustic fiber material 42, leaving the other cavity free from acoustic fiber material.

In one example, the porous partition 36 comprises a first porous partition portion 60 that is integrally formed with the first outer shell 30 and a second porous partition portion 62 that is integrally formed with the second outer shell 32. The first 60 and second 62 porous partition portions cooperate with each other to form the first 34*a* and second 34*b* sub-cavities.

In one example, each of the first 60 and second 62 porous partition portions extend inwardly toward a center of the muffler interior cavity 34 to a respective distal end 64, 66. The distal ends 64, 66 are positioned in an overlapping relationship to each other to divide the muffler interior cavity 34 into the sub-cavities.

The subject muffler 16 provides a configuration that minimizes the amount of acoustic fiber material 42 while still providing the desired acoustic benefits. Acoustic fiber material is most effective near the perforated/louvered exhaust tubes 40*a*, 40*b*. Acoustic fiber material that is positioned near an inner wall of the muffler is ineffective in attenuating exhaust noise. By integrally molding the first 60 and second 62 porous partition portions with the outer shells 30, 32, the muffler interior can be easily sub-divided into sub-cavities without requiring additional processes. Further, only minimal additional material is needed to form the porous partition portions. The wall created by the first 60 and second 62 porous partition portions retains the acoustic fiber material 42 near the perforated/louvered exhaust tube 40*a*, 40*b*. This keeps the fiber material 42 near the tubes 40*a*, 40*b* where it is the most effective but still allows the exhaust gas to see the entire muffler volume (muffler internal cavity 34) due to the openings in the tubes 40*a*, 40*b* and the porosity of the partition 36.

A method for forming the muffler 16 for the vehicle exhaust system 10 includes molding the first 30 and second 32 outer shells, which are subsequently attached to each other to define the muffler interior cavity 34, and integrally molding at least one porous partition 36 with at least one of the first 30 and second 32 outer shells. Thus, the muffler comprises a prefabricated body that forms the sub-cavities simply by attaching the shells to each other. A filling tool (not shown) is then used to put the acoustic fiber material 42 into the appropriate sub-cavity. Any type of filling tool can be used.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A muffler for a vehicle exhaust system comprising:

a first outer shell;

a second outer shell that cooperates with the first outer shell to define a muffler interior cavity;

at least one porous partition to separate the muffler interior cavity into at least first and second sub-cavities;

an exhaust tube spaced apart from the at least one partition and extending through the first sub-cavity; and acoustic fiber material only in the first sub-cavity.

2. The muffler according to claim 1 wherein the first and second shells are comprised of a molded material.

3. The muffler according to claim 2 wherein the molded material comprises a polymeric material.

4. The muffler according to claim 2 wherein the at least one porous partition is integrally molded with one of the first and second shells as a single-piece component.

5. The muffler according to claim 1 wherein the exhaust tube comprises one of a louvered or perforated tube.

6. The muffler according to claim 1 wherein the second sub-cavity is free from acoustic fiber material.

7. The muffler according to claim 1 wherein the acoustic fiber material surrounds an outer peripheral surface of the exhaust tube and fills the first sub-cavity.

8. The muffler according to claim 1 wherein the at least one porous partition comprises a first porous partition portion integrally formed with the first outer shell and a second porous partition portion integrally formed with the second outer shell, the first and second porous partition portions cooperating with each other to form the first and second sub-cavities.

9. The muffler according to claim 8 wherein each of the first and second porous partition portions extend inwardly toward a center of the muffler interior cavity to a distal end, and wherein the distal ends are positioned in an overlapping relationship to each other.

10. The muffler according to claim 1 including a muffler inlet into the first sub-cavity and a muffler outlet from the first sub-cavity, and wherein the exhaust tube extends entirely through the first sub-cavity from the muffler inlet to the muffler outlet.

11. The muffler according to claim 10 wherein the muffler inlet and outlet are formed within at least one of the first and second outer shells.

12. The muffler according to claim 1 wherein the exhaust tube only extends through the first sub-cavity.

13. A muffler for a vehicle exhaust system comprising:

a first outer shell;

a second outer shell that cooperates with the first outer shell to define a muffler interior cavity, and wherein the first and second shells are comprised of a molded material;

at least one porous partition integrally molded with one of the first and second outer shells to separate the muffler interior cavity into at least first and second sub-cavities;

a muffler inlet into the first sub-cavity, the muffler inlet formed in at least one of the first and second outer shells; and a muffler outlet from the first sub-cavity, the muffler outlet formed in at least one of the first and second outer shells.

14. The muffler according to claim 13 including an exhaust tube with a plurality of openings that extends only through the first sub-cavity, and acoustic fiber material located in the first sub-cavity.

15. The muffler according to claim 14 wherein the exhaust tube comprises a single tube that extends from the muffler inlet to the muffler outlet.

16. The muffler according to claim 14 wherein the exhaust tube is spaced apart from the at least one porous partition.

17. The muffler according to claim 13 wherein the acoustic fiber material surrounds an outer peripheral surface of the exhaust tube and fills the first sub-cavity, and wherein the second sub-cavity is free from acoustic fiber material.

18. The muffler according to claim 17 wherein the at least one porous partition comprises a first porous partition portion integrally formed with the first outer shell and a second porous partition portion integrally formed with the second outer shell, the first and second porous partition portions cooperating with each other to form the first and second sub-cavities.

19. A method of forming a muffler for a vehicle exhaust system comprising the steps of:

molding first and second outer shells that are subsequently attached to each other to define a muffler interior cavity;

integrally molding at least one porous partition with at least one of the first and second outer shells to form at least first and second sub-cavities; and forming a muffler inlet into the first cavity and a muffler outlet from the first sub-cavity, the muffler inlet and outlet being provided in at least one of the first and second outer shells.

20. The method according to claim 19 including:

attaching the first and second outer shells to each other such that the at least one porous partition divides the muffler interior cavity into the first and second sub-cavities;

installing an exhaust tube to extend only through the first sub-cavity; and introducing acoustic fiber material into the first sub-cavity.

21. The method according to claim 20 including forming the exhaust tube as a louvered or perforated exhaust tube that extends from the muffler inlet to the muffler outlet.

22. The method according to claim 20 including completely filling the first sub-cavity with acoustic fiber material leaving the second sub-cavity free from acoustic fiber material.

23. The method according to claim 19 wherein the at least one porous partition is comprised of a first porous portion and a second porous portion that cooperate with each other to divide the muffler interior cavity into first and second sub-cavities, and including integrally molding the first porous portion with the first outer shell and integrally molding the second porous portion with the second outer shell.

24. The method according to claim 20 including spacing the exhaust tube apart from the at least one porous partition.

* * * * *